US011020995B2

(12) United States Patent
Kitazawa

(10) Patent No.: US 11,020,995 B2
(45) Date of Patent: Jun. 1, 2021

(54) HEAD LEADING MEMBER, PRINTING MACHINE, AND MANUFACTURING METHOD OF HEAD LEADING MEMBER

(71) Applicant: MIMAKI ENGINEERING CO., LTD., Nagano (JP)

(72) Inventor: Toshiki Kitazawa, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 20 days.

(21) Appl. No.: 16/547,552

(22) Filed: Aug. 21, 2019

(65) Prior Publication Data

US 2020/0062013 A1 Feb. 27, 2020

(30) Foreign Application Priority Data

Aug. 24, 2018 (JP) ..... JP2018-157052

(51) Int. Cl.
*B41J 25/304* (2006.01)
*B41J 11/00* (2006.01)
*B41J 2/21* (2006.01)

(52) U.S. Cl.
CPC ..... *B41J 25/304* (2013.01); *B41J 2/2103* (2013.01); *B41J 11/005* (2013.01); *B41J 2202/22* (2013.01)

(58) Field of Classification Search
CPC ..... B41J 25/304; B41J 11/005; B41J 2/2103; B41J 2202/22; B41J 19/00; B41J 3/28
See application file for complete search history.

(56) References Cited

U.S. PATENT DOCUMENTS 6,386,681 B1 * 5/2002 Askren ..... B41J 2/17503 347/49

FOREIGN PATENT DOCUMENTS

JP 2015013455 1/2015

* cited by examiner

*Primary Examiner* — Bradley W Thies
(74) *Attorney, Agent, or Firm* — JCIPRNET

(57) ABSTRACT

To provide a head leading member with which it is possible to inexpensively lead a head with a high level of accuracy. A head leading member is a head leading member, provided in a printing machine that includes a head to discharge ink toward a working surface, for leading the head in a main travelling direction; and the head leading member comprises; a frame extending in the main travelling direction; a base member fixed to the frame, and having a guiding reference surface that is performed with a manufacture so as to be planar along the main travelling direction, in a state of being fixed to the frame; and a guide member extending in the main travelling direction and being supported on the guiding reference surface of the base member, in order to lead the head in the main travelling direction.

13 Claims, 8 Drawing Sheets

HEAD LEADING MEMBER, PRINTING MACHINE, AND MANUFACTURING METHOD OF HEAD LEADING MEMBER

CROSS REFERENCE TO RELATED APPLICATIONS

This application claims the priority benefit of Japanese Patent Application No. 2018-157052, filed on Aug. 24, 2018. The entirety of the above-mentioned patent application is hereby incorporated by reference herein and made a part of this specification.

TECHNICAL FIELD

The present disclosure relates to a head leading member, a printing machine, and a manufacturing method of the head leading member.

DESCRIPTION OF THE BACKGROUND ART

As a printing machine to carry out a printing operation for a medium, for example, there is known a printing machine of an ink-jet type, in which a liquid droplet is jetted out of a head onto a medium (for example, refer to Patent Document 1). Such a printing machine includes: for example, a placement table on which the medium can be placed; a head that jets out a liquid droplet toward a surface of the medium while the placement table is moved in a main travelling direction in a reciprocating manner; a head leading member that leads the head in the main travelling direction; and a relative movement part that moves the head and the placement table, relatively in a sub-travelling direction perpendicular to the main travelling direction.

In such a printing machine, the head leading member is prepared by way of fixing a guide member to a frame extending in the main travelling direction. As the frame, there is used a frame manufactured by way of a cutting process for an extrusion-molded piece of metal, such as aluminum, or a frame manufactured by way of a bending process on a metal plate, and the like.

[Patent Document 1]: Japanese Unexamined Patent Application Publication No. 2015-13455

Unfortunately, a frame manufactured by way of a cutting process for an extrusion-molded piece is costly. On the other hand, in the case of a frame manufactured by way of a bending process on a metal plate, a certain level of accuracy could be secured by means of reforming a mounting surface for a guide member, while it is still difficult to directly cut the mounting surface in order to secure flatness, and therefore materializing high accuracy is difficult.

Then, with the issue described above being taken into consideration, the present disclosure provides a head leading member, a printing machine, and a manufacturing method of the head leading member, with which it is possible to inexpensively lead a head with a high level of accuracy.

SUMMARY

A head leading member according to the present disclosure is a head leading member, provided in a printing machine that includes a head to discharge ink toward a working surface, for leading the head in a main travelling direction, the head leading member comprising: a frame, extending in the main travelling direction; a base member, being fixed to the frame, and having a guiding reference surface that is performed with a manufacture so as to be planar along the main travelling direction, in a state of being fixed to the frame; and a guide member, extending in the main travelling direction and being supported on the guiding reference surface of the base member, in order to lead the head in the main travelling direction.

According to this configuration, a basic configuration is materialized by fixing the base member to the frame, and the guiding reference surface of the base member is in a state of being performed with a manufacture so as to be planar along the main travelling direction. Therefore, flatness of the guiding reference surface can easily be secured by way of manufacturing the guiding reference surface of the base member, regardless of a form of the frame. Moreover, since the guide member is supported on the guiding reference surface that is performed with a manufacture so as to be planar along the main travelling direction, in a state of being fixed to the frame; the guide member can be placed along a plane with a high degree of accuracy. In this way, there can inexpensively be obtained the head leading member with which the head can be led with a high degree of accuracy.

Then, being provided in plurality, the base members may be placed, having a clearance at intervals, in the main travelling direction; and the guide member may be placed so as to over-stride across the plurality of base members.

Accordingly, while the guide member is placed along a plane with a high degree of accuracy, an impact owing to an elongation due to thermal deformation can be eased at each end part of the base members in the main travelling direction.

Moreover, each of the base members may have a plurality of concave parts in the main travelling direction, in a frame contacting surface that the frame contacts.

Accordingly, at a middle position in the main travelling direction of the frame, a stress caused by thermal deformation can be released.

Moreover, the base member may have a slit part that connects a side end in a direction perpendicular to the main travelling direction and each of the concave parts, in the frame contacting surface.

Accordingly, at the middle position in the main travelling direction of the frame, a stress caused by thermal deformation can further surely be released.

Furthermore, the guide member may be fixed to the frame, by use of a fixing member, provided so as to pass through the base member.

Thus, by means of fixing the guide member to the frame in this way, the fixing member can be arranged so as not to directly fix the base member as much as possible; and therefore, deformation of the base member can be suppressed. Therefore, it is possible to make the frame out of a material with high stiffness, while a material with a property for easily-working can be selected as a material for the base member, which is softer than the frame, in order to shape the guiding reference surface.

Furthermore, the frame may be shaped in a state where a metal plate is manufactured by way of a bending process.

Thus, even in the case of employing the frame shaped in a state where a metal plate is manufactured by way of a bending process, the head can be led with a high degree of accuracy; and therefore, the frame can be shaped at low cost.

Moreover, the printing machine may include a chassis, and the frame may be a part of the chassis included in the printing machine.

Thus, a configuration is materialized in such a way that a stiffness of the frame contributes to a stiffness of the chassis of the printing machine, so that the stiffness of the chassis of the printing machine can be enhanced.

Still further, the manufacture may be carried out by way of a cutting process.

Thus, the guiding reference surface with a high degree of accuracy can easily be shaped.

A printing machine according to the present disclosure includes: a head, discharging an ink toward a working surface; a head leading member, leading the head in a main travelling direction, according to any one of the head leading members mentioned above; and a driver, driving the head along the head leading member in the main travelling direction.

Thus, using the head leading member makes it possible to lead the head with a high degree of accuracy, so that high-accuracy printing can be carried out.

A manufacturing method of a head leading member according to the present disclosure is a manufacturing method of a head leading member, which is provided in a printing machine including a head for discharging an ink toward a working surface, in order to lead the head in a main travelling direction; the manufacturing method of a head leading member comprising: a base member fixing step in which a base member, being like a plate, is fixed to a frame extending in the main travelling direction; a guiding reference surface shaping step in which a surface of the base member, in a state of being fixed to the frame, is so manufactured as to be a plane, being along the main travelling direction, in such a way as to shape a guiding reference surface; and a guide member supporting step in which a guide member for leading the head is set in such a way that the guiding reference surface supports the guide member.

Thus, by way of manufacturing the surface of the base member, in a state of being fixed to the frame, so as to be a plane being along the main travelling direction; the guiding reference surface can efficiently be shaped with a high degree of accuracy.

Still further, the guiding reference surface may be shaped by way of a cutting process in the guiding reference surface shaping step.

Therefore, the guiding reference surface with a high degree of accuracy can easily be shaped.

According to the present disclosure, it becomes possible to provide a head leading member, a printing machine, and a manufacturing method of the head leading member, with which it is possible to inexpensively lead a head with a high level of accuracy.

DESCRIPTION OF EMBODIMENTS

A preferred embodiment with respect to a head leading member, a printing machine, and a manufacturing method of the head leading member according to the present disclosure is explained below with reference to the drawings. The present embodiment does not place any restriction on a scope of the present invention. Moreover, a constituent element in the embodiment described below includes any element with which a person skilled in the art can easily replace, and any element that is substantially the same as described below.

Figure 1:
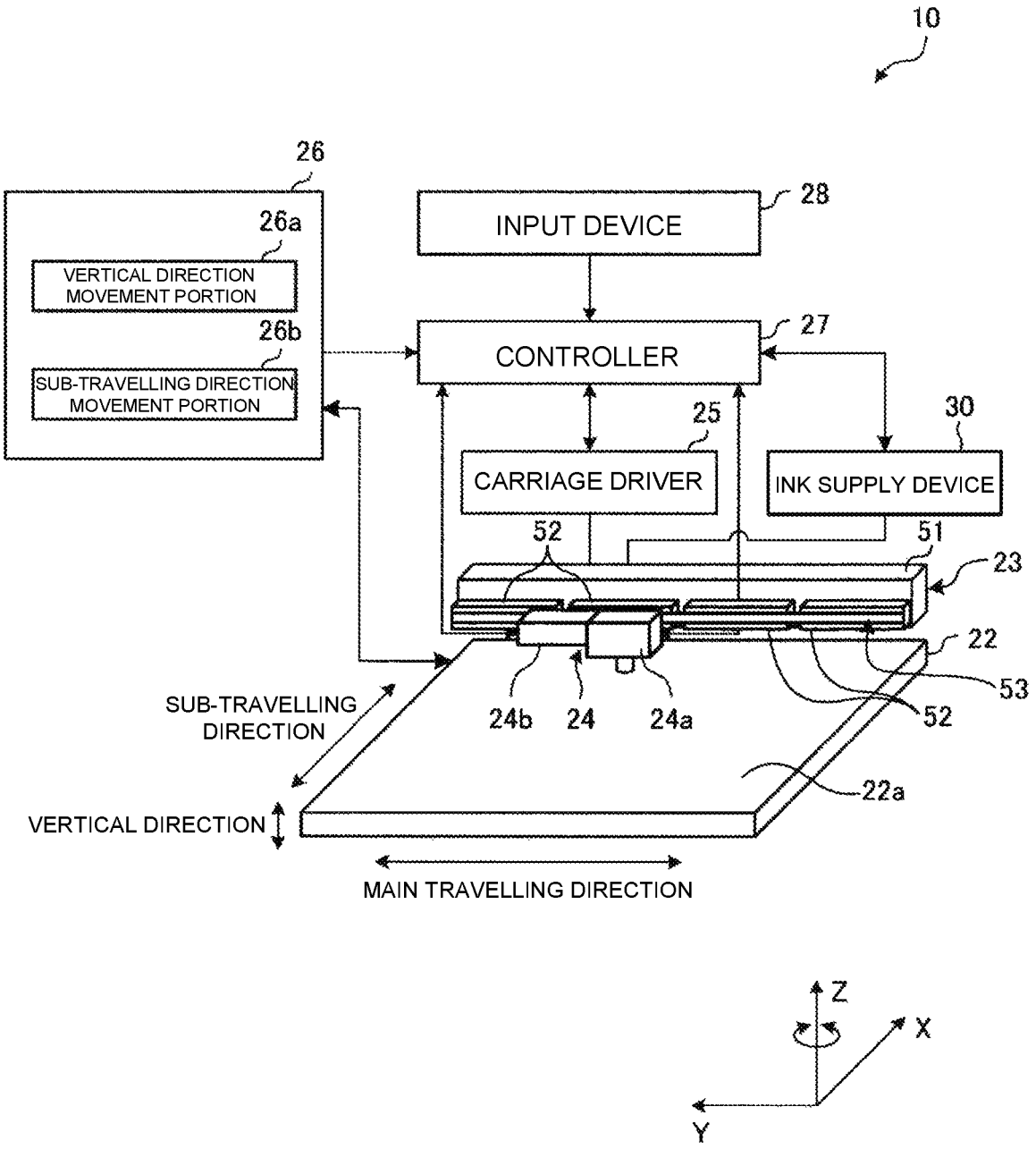
FIG. 1 is a schematic view that shows a schematic configuration example of a printing machine according to an embodiment of the present disclosure.

FIG. 1 is a schematic view drawing that shows a schematic configuration example of a printing machine 10 according to the present embodiment. In the present embodiment, an explanation is made with respect to an example in which a three-dimensional shaping device to shape, for example, a 3-dimensional shaped article is described. The printing machine 10 is not restricted to a three-dimensional shaping device, and may be another type of printing device, such as a two-dimensional printer and the like.

For example, the printing machine 10 divides the shaped article into a plurality of layers in a vertical direction based on a 3-dimensional data of the shaped article, and stacks up a shaping material in due order from a lower side layer based on a shape data of each layer of the shaped article, in such a way as to shape the shaped article in accordance with the 3-dimensional data. The printing machine 10 includes: a placement table 22 provided with a working surface 22*a* at a top surface, a 'Y' bar 23, a carriage 24, a carriage driver 25, a placement table driver 26, a controller 27, an input device 28, and an ink supply device 30.

For example, the working surface 22*a* is a plane, provided so as to be flat in a direction being parallel with an X-axis direction and a Y-axis direction, as shown in FIG. 1, and an ultraviolet (UV) hardening ink, as a shaping material, is stacked up on the working surface 22*a*, in due order from a lower side layer. Although the placement table 22 is provided, for example, in an almost rectangular shape, it is not restricted to the rectangular shape.

The 'Y' bar 23 is placed at an upper side of the placement table 22 in the vertical direction at a predetermined clearance. The 'Y' bar 23 is linearly provided along a main travelling direction, being in parallel with the Y-axis direction shown in FIG. 1. The 'Y' bar 23 leads a reciprocating movement along the main travelling direction of the carriage 24. A detailed configuration of the 'Y' bar 23 is described later.

The carriage 24 is held by the 'Y' bar 23 in such a way as to be movable along the 'Y' bar 23 in the main travelling direction in a reciprocating manner. The carriage 24 is controlled by the carriage driver 25 with respect to a movement in the main travelling direction. The carriage 24 is provided with a head 24*a* and an ultraviolet irradiator 24*b*, which are physically connected to a surface facing the placement table 22 in a vertical direction, by use of a holder and the like, being not illustrated.

While moving along the main travelling direction in a reciprocating manner in connection with a movement of the carriage 24 along the main travelling direction, the head 24*a* is able to discharge the ultraviolet (UV) hardening ink (hereinafter referred to as the 'ink'), as a shaping material, onto the working surface 22*a*. As the ink to be discharged from the head 24*a*, for example, white ink, colored ink, transparent ink, and the like can appropriately be used, in accordance with a color of a shaped article to be manufactured.

While moving along the main travelling direction in a reciprocating manner in connection with a movement of the carriage 24 along the main travelling direction, the ultraviolet irradiator 24*b* is able to radiate the ink, discharged onto the working surface 22*a*, with an ultraviolet ray. The ultraviolet irradiator 24*b* is materialized with a configuration, for example, including an LED module and the like, which can deliver irradiation of an ultraviolet ray.

Each of the head 24*a* and the ultraviolet irradiator 24*b* is electrically connected to the controller 27. A drive operation of the head 24*a* and the ultraviolet irradiator 24*b* is individually controlled by the controller 27.

The carriage driver 25 relatively moves the carriage 24, namely the head 24*a*, relative to the 'Y' bar 23 along the main travelling direction in a reciprocating manner (so as to make the carriage 24 travel). The carriage driver 25 is materialized with a configuration, including: a transmission mechanism, such as a transfer belt and the like, connected to the carriage 24; and a drive source, such as an electric motor and the like, for driving the transfer belt. The carriage driver 25 converts drive power, generated by the drive source, into drive power with which the carriage 24 is moved along the main travelling direction by the intermediary of the transmission mechanism in such a way that the carriage 24 is moved along the main travelling direction in a reciprocating manner. The carriage driver 25 is electrically connected to the controller 27, and a drive operation of the carriage driver 25 is controlled by the controller 27.

The placement table driver 26 includes: a vertical direction movement portion 26*a* and a sub-travelling direction movement portion 26*b*. The vertical direction movement portion 26*a* relatively moves the working surface 22*a* prepared on the placement table 22, relative to the head 24*a*, the ultraviolet irradiator 24*b*, and so on in a vertical direction, by way of moving the placement table 22 along a direction parallel with a Z-axis direction. In other words, the placement table driver 26 can make the working surface 22*a* approach and also withdraw from the head 24*a*, the ultraviolet irradiator 24*b*, and so on.

The sub-travelling direction movement portion 26*b* relatively moves the working surface 22*a* prepared on the placement table 22, relative to the head 24*a*, the ultraviolet irradiator 24*b*, and so on, in a reciprocating manner, by way of moving the placement table 22 in a sub-travelling direction being parallel with an X-axis direction perpendicular to the main travelling direction. In other words, the placement table driver 26 can make the working surface 22*a* move along the sub-travelling direction, relative to the head 24*a*, the ultraviolet irradiator 24*b*, and so on, in a reciprocating manner. Although the sub-travelling direction movement portion 26*b*, according to the present embodiment, moves the placement table 22 in the sub-travelling direction, an embodiment of the present disclosure is not limited to such a configuration, and alternatively the head 24*a* and the ultraviolet irradiator 24*b* together with the 'Y' bar 23 may be moved in the sub-travelling direction.

The controller 27 is materialized with a configuration, including: a hardware such as an arithmetic processor, a storage device, and the like. The storage device can store a program for materializing an arithmetic process to be carried out by the arithmetic processor, and a data to be used in the arithmetic process. The arithmetic processor materializes various processes of the three-dimensional shaping device (i.e., the printing machine 10), by way of carrying out various arithmetic processes according to the program stored in the storage device.

The controller 27 controls a discharging volume of ink, timing of a discharging operation, a discharging period, and the like, by means of controlling an operation of the head 24*a*. The controller 27 controls an intensity, exposure timing, an exposure period, and the like of an ultraviolet ray to be radiated, by means of controlling an operation of the ultraviolet irradiator 24*b*. The controller 27 controls a relative movement of the carriage 24 along the main travelling direction, by means of controlling an operation of the carriage driver 25. The controller 27 controls a relative movement of the placement table 22 along the vertical direction as well as the sub-travelling direction, by means of controlling an operation of the placement table driver 26. At a time of controlling the operation of the head 24*a*, the controller 27 is able to transmit a command signal for a start of supplying ink and a command signal for a stop of supplying ink, to the ink supply device 30.

The input device 28 is connected to the controller 27. The input device 28 works for an input of a 3-dimensional data relating to a shape of a shaped article. The input device 28 is configured with an electronic device, for example, such as a computer, a tablet, a smartphone, and the like, and the electronic device is connected to the controller 27 by way of a wired connection or a wireless connection.

Figure 2:
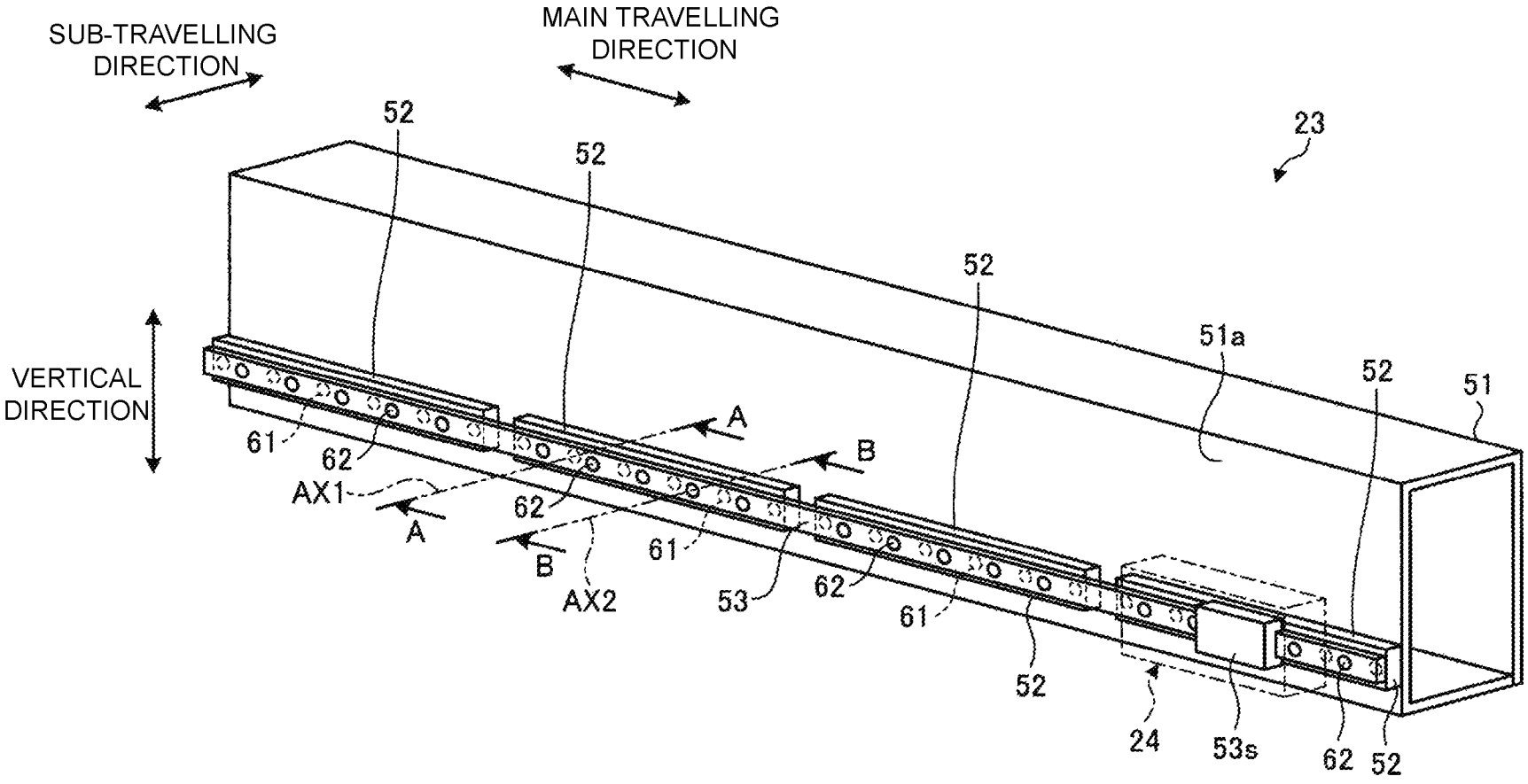
FIG. 2 is a perspective view that shows an example of a 'Y' bar.
Figure 3:
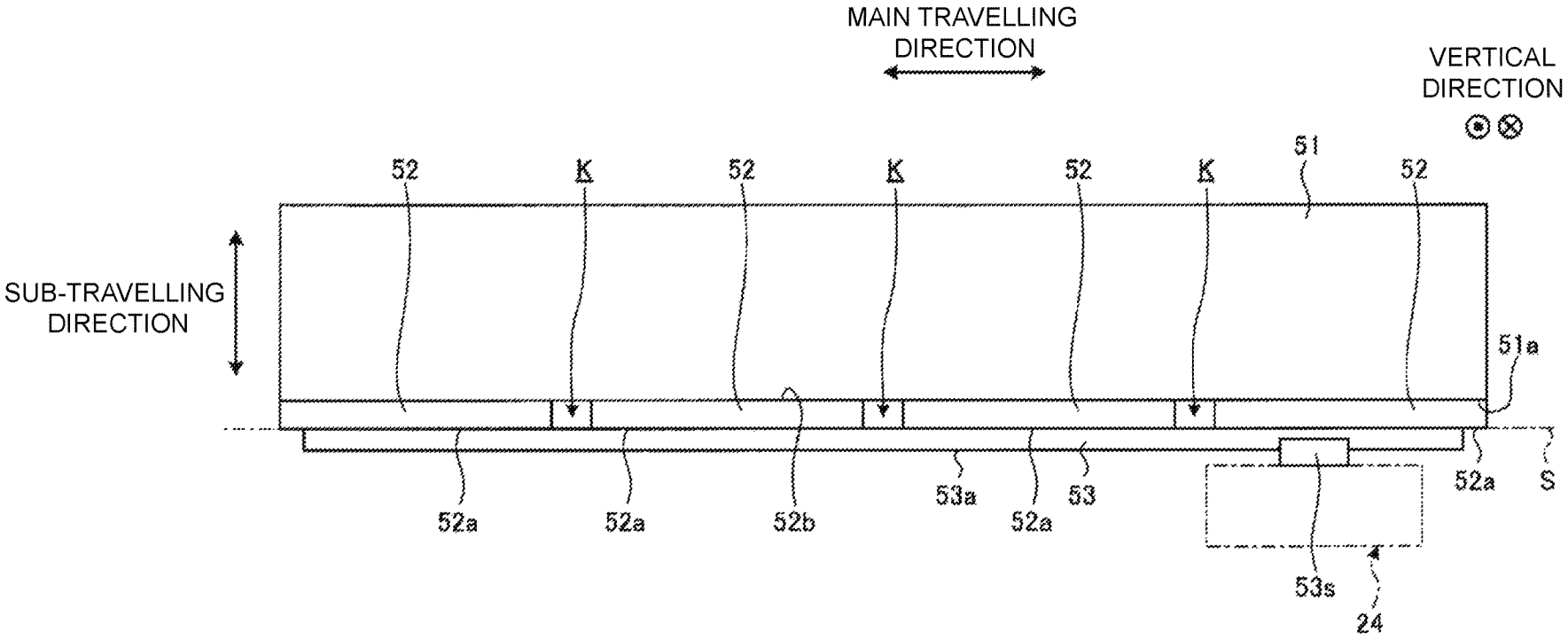
FIG. 3 is a diagram that shows an example at a time of observing the 'Y' bar from an upper side in a vertical direction.

FIG. 2 is a perspective view that shows an example of the 'Y' bar 23. FIG. 3 is a diagram that shows an example at a time of observing the 'Y' bar 23 from an upper side in a vertical direction. As shown in FIG. 2 and FIG. 3, the 'Y' bar 23 includes: a frame 51, a base member 52, and a guide member 53.

The frame 51 extends in the main travelling direction. The frame 51 is shaped in a state where, for example, a metal plate of iron and the like is bent. The frame 51 includes a mounting surface 51*a* to which the base member 52 and the guide member 53 are fixed.

Figure 4:
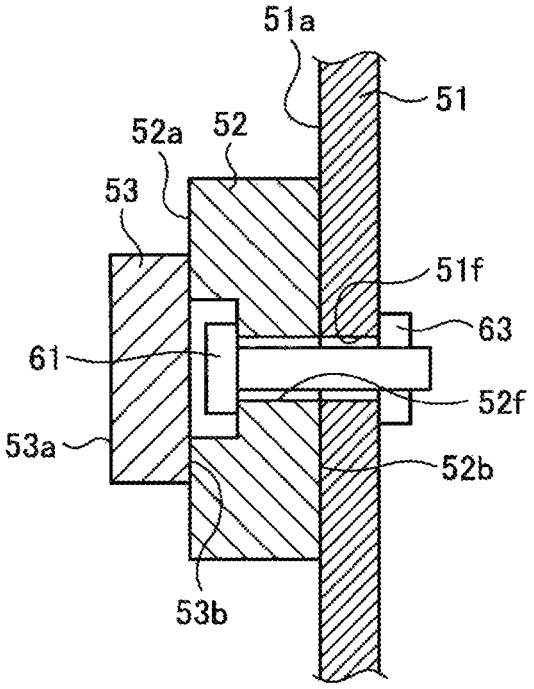
FIG. 4 is a diagram that shows a configuration taken along an A-A sectional view in FIG. 2.
Figure 5:
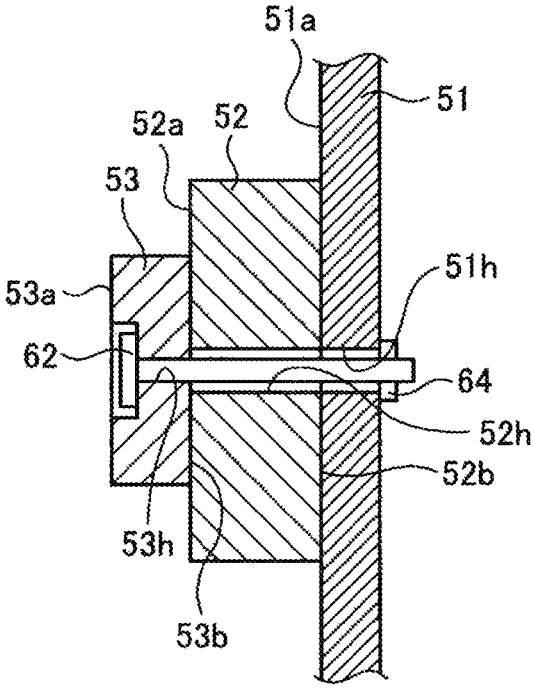
FIG. 5 is a diagram that shows a configuration taken along a B-B sectional view in FIG. 2.

FIG. 4 is a diagram that shows a configuration taken along an A-A sectional view in FIG. 2. The A-A sectional view shows a cross-sectional surface of a plane, which is with respect to one of bolts 61, to be described later; the plane including a central axis AX1, and being perpendicular to the main travelling direction. FIG. 5 is a diagram that shows a configuration taken along a B-B sectional view in FIG. 2. The B-B sectional view shows a cross-sectional surface of a plane, which is with respect to one of bolts 62, to be described later; the plane including a central axis AX2, and being perpendicular to the main travelling direction.

As shown in FIG. 4 and FIG. 5, in the mounting surface 51*a* of the frame 51, there are formed a bolt insertion hole 51*f* and a bolt insertion hole 51*h*. Into the bolt insertion hole 51*f*, there is inserted each of the bolts 61 for fixing the base member 52, to be described later, to the frame 51. Into the bolt insertion hole 51*h*, there is inserted each of the bolts 62 for fixing the guide member 53, to be described later, to the frame 51.

Being shaped like a plate, the base member 52 is fixed to the mounting surface 51*a* of the frame 51. The base member 52 includes a guiding reference surface 52*a*. The guiding reference surface 52*a* is manufactured in such a way as to be planar along a main travelling direction in a state of being fixed to the frame 51. Individually, the guiding reference surface 52*a* of the base member 52 is placed in one virtual plane 'S' (refer to FIG. 3) that is, for example, in parallel with the main travelling direction and perpendicular to the sub-travelling travelling direction. A plurality of base members 52 are placed, having a clearance at intervals, in the main travelling direction. When the base members 52 are thermally deformed in the main travelling direction, a stress caused by the thermal deformation can be released, because of the plurality of base members 52 being placed, having a clearance at intervals in the main travelling direction.

Figure 6:
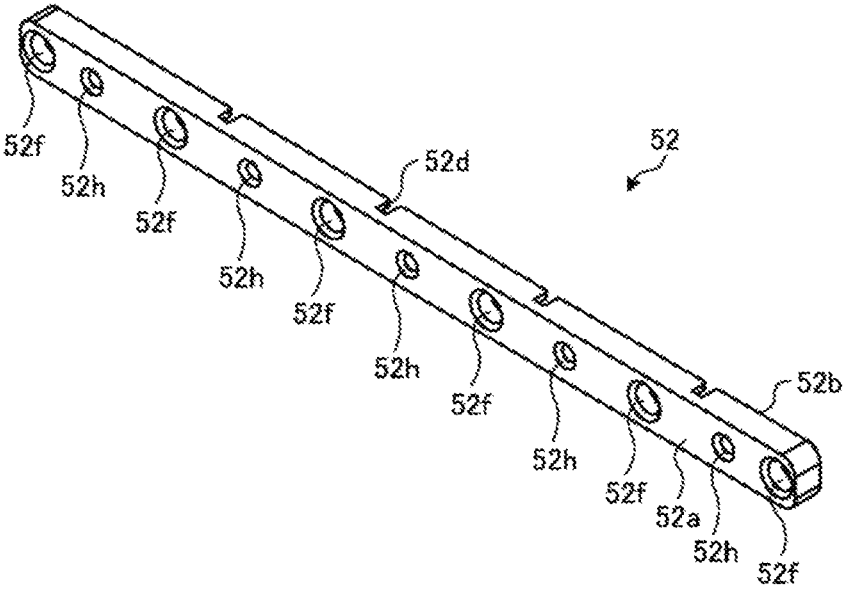
FIG. 6 is a perspective view that shows an example of a base member.
Figure 7:
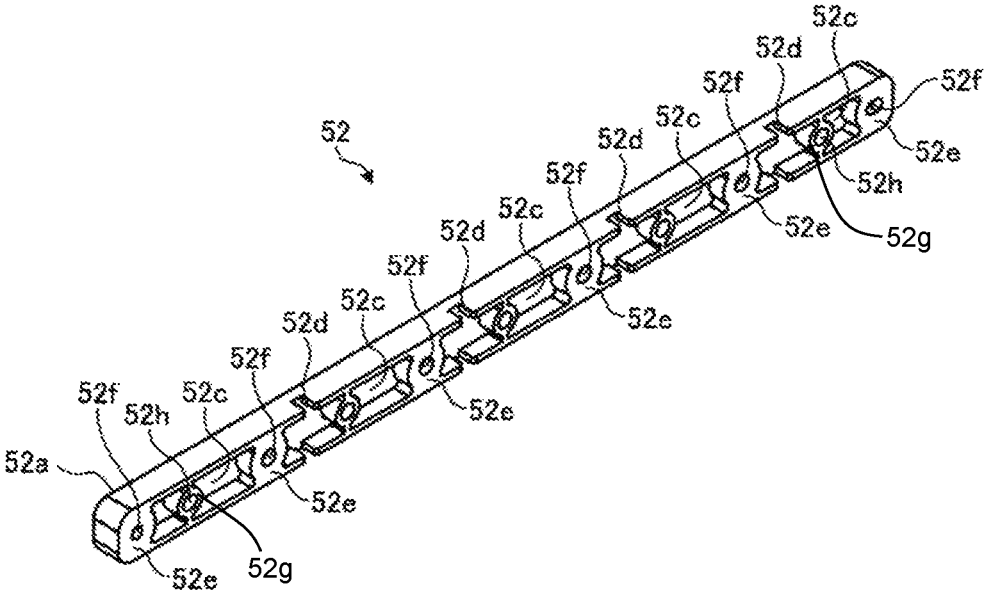
FIG. 7 is a perspective view that shows an example of the base member.

FIG. 6 and FIG. 7 are perspective views that show an example of the base members 52. FIG. 6 shows one of the plurality of base members 52, viewed from a side of the guiding reference surface 52*a*. Meanwhile, FIG. 7 shows the one of the plurality of base members 52, viewed from a side of a frame contacting surface 52*b*.

Each of the base members 52 has the frame contacting surface 52*b* that contacts the frame 51. The frame contacting surface 52*b* has a concave part 52*c*. Though the concave part 52*c* is shaped, for example, so as to have a form stretched in the main travelling direction, a shape is not restricted to the form, and another shape may be applied. In the frame contacting surface 52*b*, the base members 52 includes a slit part 52*d* that extends through the concave part 52*c* in a direction perpendicular to the main travelling direction. The slit part 52*d* extends to both sides at an upper side end and a lower side end of the concave part 52*c*. The slit part 52*d* is placed up to an upper side end and a lower side end of the frame contacting surface 52*b*. Though the base members 52 is shaped, for example, by use of a metal, such as aluminum and the like, whose surface can easily be manufactured; a material is not limited to such a metal, and the base members 52 may be shaped by use of any other metal, such as iron and the like.

The base member 52 is provided with a fixing support part 52*e* between neighboring concave parts 52*c*, in the main travelling direction. The fixing support part 52*e* has a bolt insertion hole 52*f* that goes through the base member 52 in its thickness direction. Through the bolt insertion hole 52*f*, there is inserted each of the bolts 61 for fixing the base member 52 to the frame 51. Moreover, in the concave part 52*c*, there is provided a passing-through support part 52*g*. The passing-through support part 52*g* has a bolt insertion hole 52*h* that goes through the base member 52 in its thickness direction. Through the bolt insertion hole 52*h*, there is inserted each of the bolts 62 for fixing the guide member 53 to the frame 51. In the present embodiment, the frame contacting surface 52*b* is configured in such a way as to include an edge part of the concave part 52*c*, an edge part of the bolt insertion hole 52*f* at the fixing support part 52*e*, and an edge part of the bolt insertion hole 52*h* at the passing-through support part 52*g*.

The guide member 53 is, for example, shaped like a bar, and supported by the guiding reference surface 52*a* of the base member 52. The guide member 53 extends in the main travelling direction, in such a way as to lead the carriage 24 in the main travelling direction. The guide member 53 is placed so as to over-stride across the plurality of base members 52. The guide member 53 is fixed to the frame 51 by use of the bolts 62 that are provided so as to pass through the base members 52 in the sub-travelling direction.

The guide member 53 has a head leading surface 53*a*. The head leading surface 53*a* is, for example, like a plane that is in parallel with the guiding reference surface 52*a*. To the guide member 53, there is installed a slider 53S. The slider 53S is provided so as to be movable along the guide member 53 in the main travelling direction. To the slider 53S, there is mounted the carriage 24. As the slider 53S moves in the main travelling direction, the carriage 24 and therefore the head 24*a* are moved in the main travelling direction.

Figure 8:
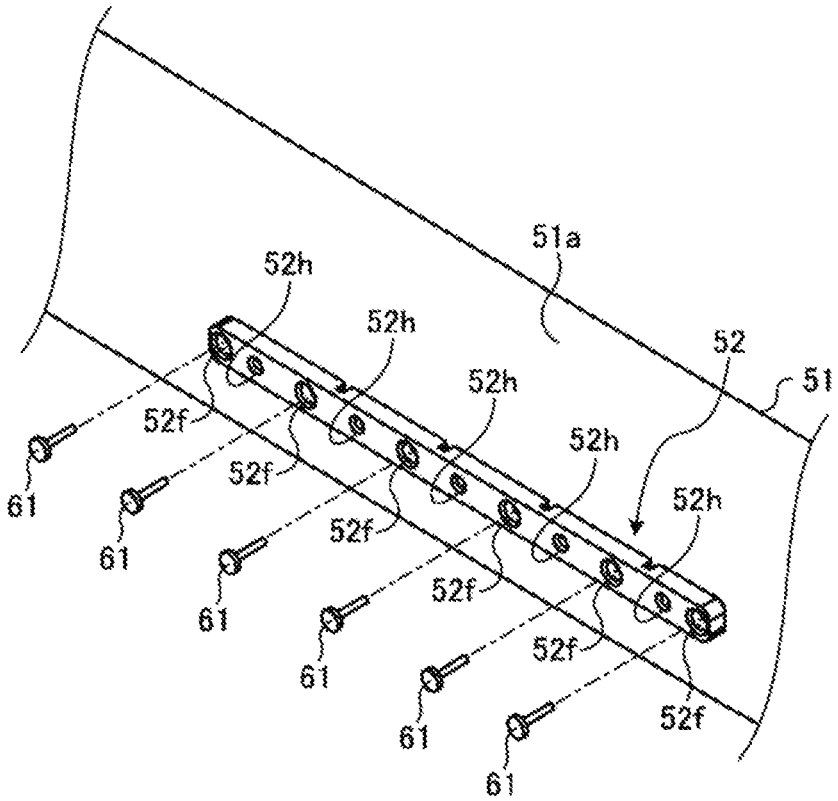
FIG. 8 is a diagram that shows a configuration for fixing the base member to a frame.

FIG. 8 is a diagram that shows a configuration for fixing the base member 52 to the frame 51. As shown in FIG. 8, a plurality of bolts 61 are individually inserted through the bolt insertion hole 52*f*, from a side of the guiding reference surface 52*a*, in the base member 52. Then, as shown in FIG. 4, in a state where the bolts 61 are individually inserted through the bolt insertion hole 52*f*, each tip part of the bolts 61 passes through up to an internal side of the frame 51. The base member 52 is fastened to the frame 51, by way of placing a nut 63 onto each tip part of the bolts 61.

Figure 9:
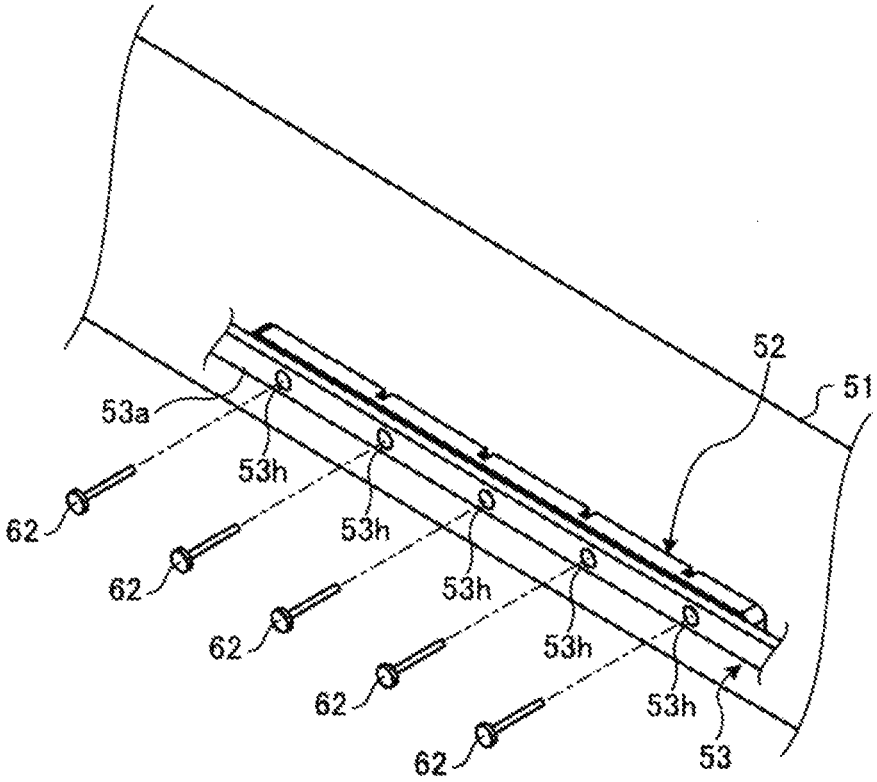
FIG. 9 is a diagram that shows a configuration for fixing a guide member to the frame.

FIG. 9 is a diagram that shows a configuration for fixing the guide member 53 to the frame 51. As shown in FIG. 9, a plurality of bolts 62 are individually inserted through a bolt insertion hole 53*h*, from a side of the head leading surface 53*a*, in the guide member 53. Then, as shown in FIG. 5, in a state where the bolts 62 are individually inserted through the bolt insertion hole 53*h*, each tip part of the bolts 62 passes through up to the internal side of the frame 51. The guide member 53 is fastened to the frame 51, by way of placing a nut 64 onto each tip part of the bolts 62.

Figure 10:
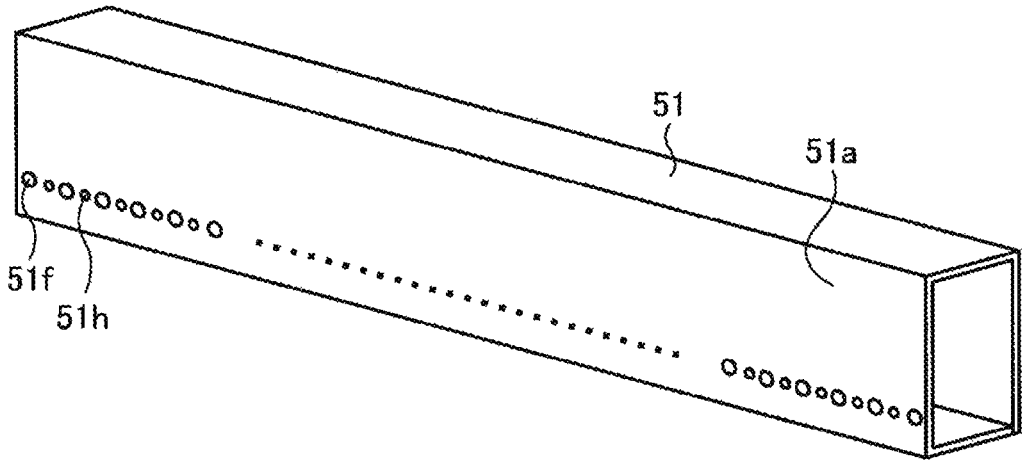
FIG. 10 is a perspective view that shows an example of a process of manufacturing the 'Y' bar.

Explained next is a manufacturing method of the 'Y' bar 23 configured as described above. FIG. 10 through FIG. 13 are perspective views that show an example of a process of manufacturing the 'Y' bar 23. At first, as shown in FIG. 10, the bolt insertion hole 51*f* and the bolt insertion hole 51*h* are shaped, for example, by way of drilling a metal plate such as an iron plate and the like, and then the metal plate is bent to form the frame 51, stretching in the main travelling direction (a frame shaping step). In the frame shaping step, the mounting surface 51*a* is shaped by way of bending the metal plate.

Figure 11:
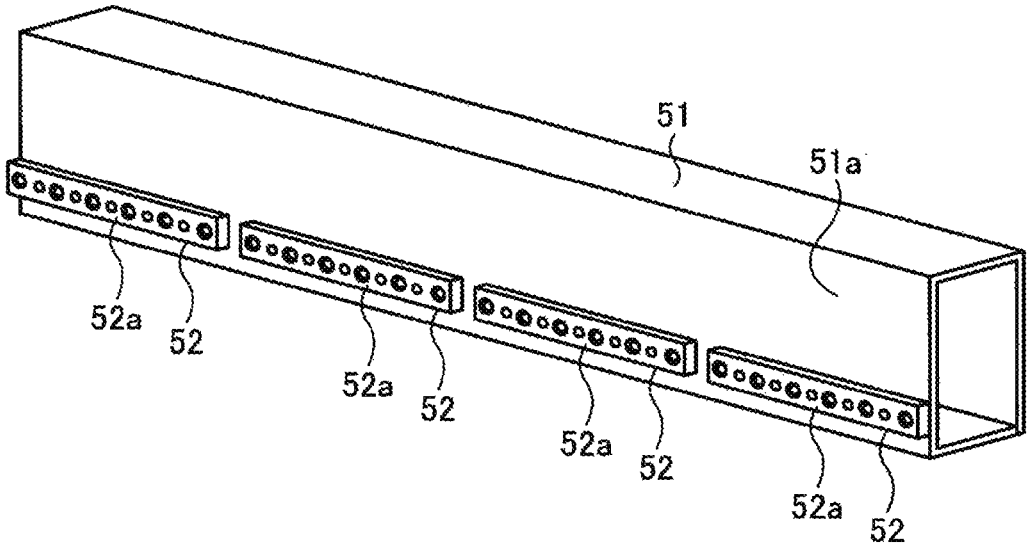
FIG. 11 is a perspective view that shows an example of a process of manufacturing the 'Y' bar.

Next, as shown in FIG. 11, the base member 52, being like a plate, is fixed to the mounting surface 51*a* of the frame 51 (a base member fixing step). In the base member fixing step, at first, the base member 52 is aligned on the mounting surface 51*a*, by way of aligning the bolt insertion hole 51*f* and the bolt insertion hole 51*h* at a side of the frame 51, with the bolt insertion hole 52*f* and the bolt insertion hole 52*h* at a side of the base member 52. Then, the bolts 61 are individually inserted in such a way as to pass through the bolt insertion hole 52*f* and the bolt insertion hole 51*f*, and each tip part of the bolts 61 is fixed by use of the nut 63.

Figure 12:
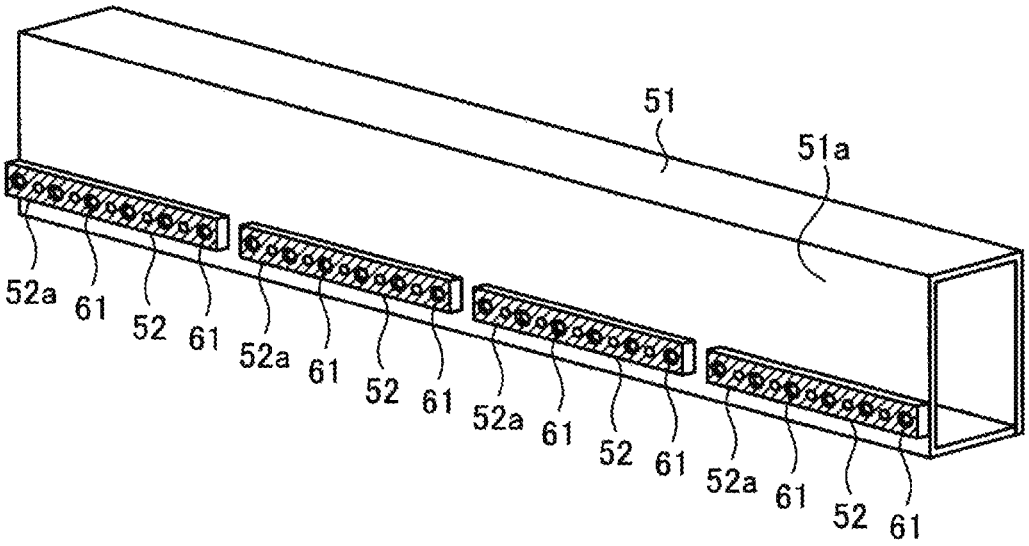
FIG. 12 is a perspective view that shows an example of a process of manufacturing the 'Y' bar.

Next, as shown in FIG. 12, in a state where the base member 52 is fixed to the frame 51, a surface of the base member 52 is so manufactured as to be a plane in such a way as to shape the guiding reference surface 52*a* (a guiding reference surface shaping step). In the guiding reference surface shaping step, a cutting process is carried out in such a way that guiding reference surfaces 52*a* of a plurality of base members 52 are placed in the one virtual plane 'S' (refer to FIG. 3). By way of shaping the guiding reference surfaces 52*a* after fixing the base members 52 to the frame 51, the guiding reference surfaces 52*a* can be shaped with a high degree of accuracy.

Figure 13:
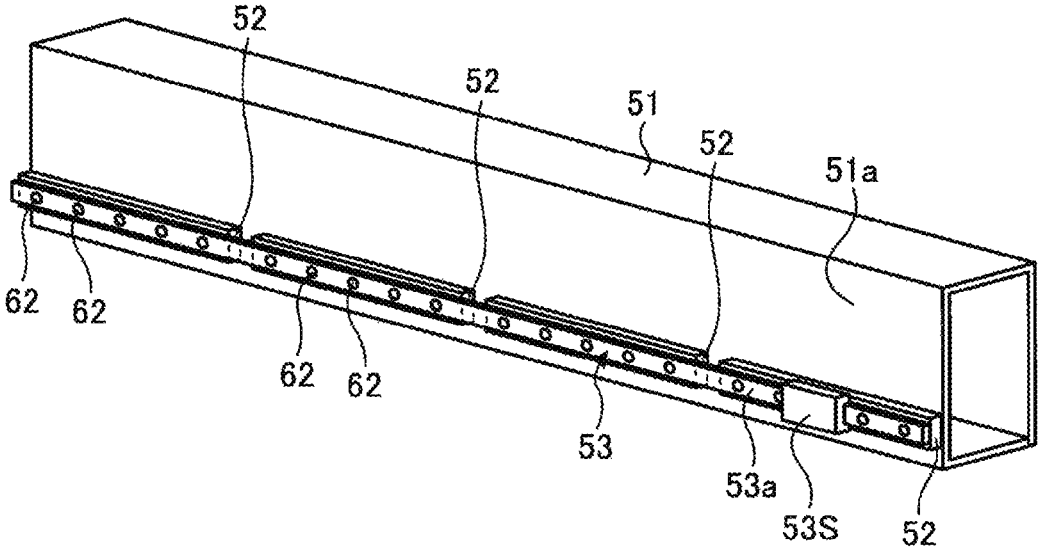
FIG. 13 is a perspective view that shows an example of a process of manufacturing the 'Y' bar.

Next, as shown in FIG. 13, the guide member 53 is set in such a way that the guiding reference surfaces 52*a* support the guide member 53 (a guide member supporting step). In the guide member supporting step, at first, the guide member 53 is aligned on the guiding reference surfaces 52*a*, by way of aligning the bolt insertion hole 52*h* at the side of the base member 52, with the bolt insertion hole 53*h* at a side of the guide member 53. Then, the bolts 62 are individually inserted in such a way as to pass through the bolt insertion hole 53*h*, the bolt insertion hole 52*h*, and the bolt insertion hole 51*h*; and each tip part of the bolts 62 is fixed by use of the nut 64. Accordingly, in a state being supported on the guiding reference surfaces 52*a*, the guide member 53 is fixed to the frame 51. Subsequently, by means of an installation of the slider 53S to the guide member 53, the 'Y' bar 23 becomes finished.

As explained above, the 'Y' bar 23 as a head leading member according to the present embodiment is a component, which is provided in the printing machine 10 equipped with the head 24*a* for discharging ink toward the working surface 22*a*, in order to lead the head 24*a* in the main travelling direction; and the 'Y' bar 23 includes: the frame 51 extending in the main travelling direction; the base member 52 being like a plate and fixed to the frame 51, and having the guiding reference surface 52*a* that is so manufactured as to be planar along the main travelling direction, in a state of being fixed to the frame 51; and the guide member 53 extending in the main travelling direction and being supported on the guiding reference surfaces 52*a* of the base member 52, in order to lead the head 24*a* in the main travelling direction.

According to this configuration, since the guide member 53 is supported on the guiding reference surface 52*a* that is so manufactured as a plane, in a state of being fixed to the frame 51, the guide member 53 can be placed along the plane with a high degree of accuracy. Accordingly, a burden on manufacturing work can be eased, and there can be obtained the 'Y' bar 23 that is able to lead the head 24*a* with a high degree of accuracy.

In the 'Y' bar 23 described above, being provided in plurality, the base members 52 are placed, having a clearance at intervals, in the main travelling direction; and meanwhile, the guide member 53 is placed so as to overstride across the plurality of base members 52. Accordingly, while the guide member 53 is placed along the plane with a high degree of accuracy, an impact owing to an elongation due to thermal deformation can be eased at each end part of the base members 52 in the main travelling direction.

Moreover, in the 'Y' bar 23 described above, each of the base members 52 has a plurality of concave parts 52*c* in the main travelling direction, in the frame contacting surface 52*b* that the frame 51 contacts. Accordingly, at a middle position in the main travelling direction of the frame 51, a stress caused by thermal deformation can be released.

Furthermore, in the 'Y' bar 23 described above, the base member 52 has the slit part 52*d* that connects a side end in a direction perpendicular to the main travelling direction to the concave part 52*c*, in the frame contacting surface 52*b*. Accordingly, at the middle position in the main travelling direction of the frame 51, a stress caused by thermal deformation can further surely be released.

Moreover, in the 'Y' bar 23 described above, the guide member 53 is fixed to the frame 51, by use of the bolts 62, provided so as to pass through the base member 52, and nuts 64. Thus, by means of fixing the guide member 53 to the frame 51 in this way, it becomes possible to prevent, for example, a tightening force of the nuts 64 from causing an impact on the base member 52. Therefore, it is possible to make the frame 51 out of a material with high stiffness, while a material with a property for easily-working, which is softer than the frame 51, can be selected as a material for the base member 52 in order to shape the guiding reference surface 52*a*.

Moreover, in relation to the 'Y' bar 23 described above, the frame 51 is shaped in a state where a metal plate is manufactured by way of a bending process. Thus, even in the case of employing the frame 51 shaped in a state where a metal plate is manufactured by way of a bending process, the head 24*a* can be led with a high degree of accuracy, and therefore, the frame 51 can be shaped at low cost.

Furthermore, in relation to the 'Y' bar 23 described above, the printing machine 10 includes a chassis, and the frame 51 is a part of the chassis included in the printing machine 10. Thus, a configuration is materialized in such a way that a stiffness of the frame 51 contributes to a stiffness of the chassis of the printing machine 10, so that the stiffness of the chassis of the printing machine 10 can be enhanced.

Moreover, in relation to the 'Y' bar 23 described above, the manufacture is carried out by way of a cutting process. Therefore, the guiding reference surface 52*a* with a high degree of accuracy can easily be shaped.

The printing machine 10 according to the present disclosure includes: the head 24*a* for discharging ink toward the working surface 22*a*; the 'Y' bar 23 described above for leading the head 24*a* in the main travelling direction; and the carriage driver 25 for driving the head 24*a* along the 'Y' bar 23 in the main travelling direction. Therefore, using the 'Y' bar 23 makes it possible to lead the head 24*a* with a high degree of accuracy, so that high-accuracy printing can be carried out.

A manufacturing method of the 'Y' bar 23 in relation to the present disclosure is a manufacturing method of the 'Y' bar 23, which is provided in the printing machine 10 including the head 24*a* for discharging ink toward the working surface 22*a*, in order to lead the head 24*a* in the main travelling direction, wherein the manufacturing method of the 'Y' bar 23 includes: the base member fixing step in which the base member 52, being like a plate, is fixed to the frame 51 extending in the main travelling direction; the guiding reference surface shaping step in which a surface of the base member 52, in a state of being fixed to the frame 51, is so manufactured as to be a plane, being along the main travelling direction, in such a way as to shape the guiding reference surface 52*a*; and the guide member supporting step in which the guide member 53 for leading the head 24*a* is set in such a way that the guiding reference surfaces 52*a* support the guide member 53. Thus, by way of manufacturing the surface of the base member 52, in a state of being fixed to the frame 51, the guiding reference surface 52*a* can efficiently be shaped with a high degree of accuracy.

Moreover, in the manufacturing method of the 'Y' bar 23, the guiding reference surface 52*a* is shaped by way of a cutting process in the guiding reference surface shaping step. Therefore, the guiding reference surface 52*a* with a high degree of accuracy can easily be shaped.

A technical scope of the present disclosure is not restricted to the embodiment described above, and various modifications can be made within a scope having no alteration in the gist of the present disclosure. For example, although the embodiment described above explains an example in which the frame 51 is shaped by way of a bending process for a metal plate, manufacture is not limited to the method describe above. For example, the frame 51 may be shaped by way of extrusion molding for metal, such as aluminum and the like.

Moreover, although the embodiment described above explains a configuration example in which the plurality of base members 52 are placed in the main travelling direction, placement is not limited to the configuration described above, and there may be placed one and only base member 52 in a state of extending in the main travelling direction.

Furthermore, although the embodiment described above explains a configuration example in which the base members 52 are made by use of aluminum, a configuration is not limited to the material mentioned above. The base members 52 may be made by use of any other metal, such as iron and the like.

What is claimed is:

1. A head leading member, being provided in a printing machine that includes a head to discharge an ink toward a working surface, for leading the head in a main travelling direction, the head leading member comprising:

a frame, extending in the main travelling direction;

a base member, being fixed to the frame, and having a guiding reference surface that is performed with a manufacture so as to be planar along the main travelling direction, in a state of being fixed to the frame; and a guide member, extending in the main travelling direction and being supported on the guiding reference surface of the base member, in order to lead the head in the main travelling direction.

2. The head leading member according to claim 1, wherein a plurality of the base members is provided;

the base members are placed, having a clearance at intervals, in the main travelling direction; and the guide member is placed so as to over-stride across the plurality of base members.

3. The head leading member according to either of claim 2, wherein each of the base members has a plurality of concave parts in the main travelling direction, in a frame contacting surface that the frame contacts.

4. The head leading member according to claim 2, wherein the guide member is fixed to the frame, by use of a fixing member, provided so as to pass through the base member.

5. The head leading member according to claim 1, wherein each of the base members has a plurality of concave parts in the main travelling direction, in a frame contacting surface that the frame contacts.

6. The head leading member according to claim 5, wherein the base member has a slit part that connects a side end in a direction perpendicular to the main travelling direction and each of the concave parts, in the frame contacting surface.

7. The head leading member according to claim 6, wherein the guide member is fixed to the frame, by use of a fixing member, provided so as to pass through the base member.

8. The head leading member according to claim 5, wherein the guide member is fixed to the frame, by use of a fixing member, provided so as to pass through the base member.

9. The head leading member according to claim 1, wherein the guide member is fixed to the frame, by use of a fixing member, provided so as to pass through the base member.

10. The head leading member according to claim 1, wherein the frame is shaped in a state where a metal plate is manufactured by way of a bending process.

11. The head leading member according to claim 1, wherein the printing machine includes a chassis, and the frame is a part of the chassis included in the printing machine.

12. The head leading member according to claim 1, wherein the manufacture is carried out by way of a cutting process.

13. A printing machine comprising:

a head, discharging an ink toward a working surface;

a head leading member according to claim 1, leading the head in a main travelling direction; and a driver, driving the head along the head leading member in the main travelling direction.

* * * * *